US005748157A

United States Patent [19]

Eason

[11] Patent Number: 5,748,157

[45] Date of Patent: May 5, 1998

[54] DISPLAY APPARATUS UTILIZING PERSISTENCE OF VISION

[76] Inventor: Richard O. Eason, RFD 5, Box 240K, Bangor, Me. 04401

[21] Appl. No.: 364,312

[22] Filed: Dec. 27, 1994

[51] Int. Cl.[6] ..... G09G 3/20

[52] U.S. Cl. ..... 345/31; 345/39

[58] Field of Search ..... 345/31, 39, 46, 345/56, 84; 359/36, 212, 221; 340/815.45; 362/102; 36/137

[56] References Cited

U.S. PATENT DOCUMENTS

| | | | |
|---|---|---|---|
| 4,160,973 | 7/1979 | Berlin, Jr. | 345/31 |
| 4,689,604 | 8/1987 | Sokol | 345/31 |
| 5,027,112 | 6/1991 | Ross et al. | 345/56 |
| 5,036,442 | 7/1991 | Brown | 362/102 |
| 5,057,827 | 10/1991 | Nobile et al. | 345/31 |
| 5,081,568 | 1/1992 | Dong et al. | 362/184 |
| 5,180,912 | 1/1993 | McEwen | 250/234 |
| 5,192,864 | 3/1993 | McEwen | 250/234 |
| 5,302,965 | 4/1994 | Belcher et al. | 345/31 |
| 5,406,300 | 4/1995 | Tokimoto et al. | 345/31 |
| 5,444,456 | 8/1995 | Ohta et al. | 345/46 |
| 5,457,900 | 10/1995 | Roy | 36/137 |
| 5,548,300 | 8/1996 | Tokimoto | 345/39 |

OTHER PUBLICATIONS

Edwards, Scott, "The Picture Stick", Electronics Now, pp. 35–41, Oct. 1994.

*Primary Examiner*—Raymond J. Bayerl
*Assistant Examiner*—Seth D. Vail
*Attorney, Agent, or Firm*—William B. Ritchie

[57] ABSTRACT

A display device is constructed with a support for cyclic or repetitive motion. An array of lights is mounted on the support for sweeping across a region of space during motion of the support. A microcontroller or other microprocessor is coupled to the lights for turning on and off the respective lights of the array. A periodically actuated switch such as an inertial switch is coupled to the microcontroller for measuring the time period or cycle time of a cycle of the cyclic or repetitive motion of the support and for indicating initiation of a cycle. The microcontroller is programmed for synchronizing the turning on and off of respective lights of the array according to the time period or cycle time of a cycle of the cyclic or repetitive motion of the support for forming at least one image across the region of space swept by the array of lights using persistence of vision of a viewer. According to one example the support is a hand held wand for hand held swinging motion back and forth. The array of lights is a column of LED's mounted along the wand for sweeping across a two dimensional area of space. The swinging motion of the wand back and forth can form e.g. alphanumeric characters, words, and sentences for conveying messages. Animated images may also be displayed. Other display devices in other environments with periodic, cyclic, or repetitive motion are also described.

25 Claims, 10 Drawing Sheets

DISPLAY APPARATUS UTILIZING PERSISTENCE OF VISION

TECHNICAL FIELD

This invention relates to a new display device using the characteristic persistence of vision of human viewers. The display device can for example be hand held and operated by hand in a swinging motion reciprocating back and forth, in a circular pattern, or in other cyclic, repetitive, or periodic motions. The display device can also operate in other environments with a cyclic, periodic, or repetitive motion such as for example on running shoes, walking shoes, bicycle pedals, bicycle spokes, and batons, etc. The display device can produce 3-D images as well as 2-D images. The display device uses a microprocessor controlled array of lights turning on and off to form image pixels while the array of lights sweeps across a region of space. The lights are automatically synchronized with the period or cycle time of a cycle of the reciprocating motion back and forth, of the circular pattern, or of other cyclic or repetitive motions which may have a variable rate.

BACKGROUND ART

The characteristic persistence of vision of human viewers has been used to advantage in previous display devices. The Belcher et al. U.S. Pat. No. 5,302,965 describes a rotating display device which rotates vertical columns of light emitting diodes. The light emitting diodes arranged in the vertical columns sweep around a cylindrical surface. A control circuit turns the light emitting diodes on and off to provide an image display on the cylindrical surface. The Belcher et al. display device requires a complex electromechanical device with a motor for rotating the LED columns at a uniform rate of rotation. The Sokol U.S. Pat. No. 4,689,604 describes another rotating drum visual display.

The McEwen et al. U.S. Pat. No. 5,180,912 and U.S. Pat. No. 5,192,864 describe a variation on this theme in which a linear array of LED's is stationary and a motor rotates a mirrored surface or facet of a polygon to create the effect of rotary motion of the LED array. The persistence of vision of a human observer again produces a two dimensional image as the LED's are selectively controlled.

A disadvantage of traditional persistence of vision display devices is that complex electromechanical devices are required for producing uniform rotary motion. The prior technology cannot be used for example for simple hand held devices that can for example be hand operated by sweeping a support across a region of space in reciprocating, circular, or other cyclic or periodic notions and patterns. The prior art devices also cannot adjust to different and variable periods or cycle times of different human users or varying use of the same user sweeping such a display device across a region of space in a back and forth, circular, or other cyclic or repetitive motion.

OBJECTS OF THE INVENTION

It is therefore an object of the present invention to provide a new simplified display device based on the visual persistence of human viewers and observers. According to the invention the new display device does not require uniform rotary motion and the motion can vary between human users and even with the same user.

Another object of the invention is to provide a display device using the principle of visual persistence in which the display device can be hand held and operated by hand for example by swinging motion back and forth, by circular motion, or by other cyclic periodic or repetitive motions. The invention is intended for operating in any suitable environment of reciprocating motion back and forth, circular motion, or other cyclic or repetitive motion such as for example running shoes, bicycle pedals, bicycle spokes, walking shoes, batons, etc.

A further object of the invention is to provide such a display device which automatically senses changes in the period or cycle time of the motion for synchronizing the displayed images in variable rate repetitive motion environments.

DISCLOSURE OF THE INVENTION

In order to accomplish these results the invention provides a display device with a support constructed for cyclic or repetitive motion. An array of lights is mounted on the support for sweeping across a region of space during motion of the support. A microcontroller, microprocessor, or other controller is coupled to the lights for turning on and off the respective lights of the array. A periodically actuated timing switch is mounted relative to the support and is coupled to the controller for measuring the time interval or cycle time of a cycle of the repetitive motion of the support and for indicating the start of each period or cycle of the repetitive motion.

According to the invention the controller is programmed for synchronizing the turning on and off of respective lights of the array according to the time interval or cycle time of a cycle of the cyclic motion of the support. The display device therefore accommodates variable rates in the cyclic motion of the support according to the user and according to the different environments. The synchronized array of lights forms an image across the region of space swept by the array of lights using persistence of vision of a viewer. Multiple images can also be formed across the region of space swept by the display device.

In a preferred example embodiment the support is a hand held wand for hand held swinging motion back and forth. The array of lights is a column of lights mounted along the wand for sweeping across a two dimensional area of space during hand held swinging motion of the wand back and forth. The lights are typically a column array of LED's.

According to one example a microcontroller is programmed for synchronizing the turning on and off of respective lights according to the measured cycle time of the hand held swinging motion of the wand back and forth to form alphanumeric characters. The alphanumeric characters form words during swinging motion of the wand and successive words displayed during swinging motion of the wand form a sentence or phrase. In this way messages can be conveyed to observers nearby or even at distant locations in view of the swinging motion of the wand. The microcontroller can of course be programmed to display any desired images.

The microcontroller can be programmed for synchronizing the turning on and off of respective lights to form alphanumeric characters or other displays for one direction of motion of the swing of the wand and to turn off the lights for the other direction of motion of the swing of the wand for that cycle. Alternatively the microcontroller can be programmed for synchronizing the turning on and off of respective lights to form alphanumeric characters or other images during both directions of motion of the swing of the wand during a cycle of the swinging motion back and forth.

In one embodiment the periodic switch is an inertial switch. One example of an inertial switch is a pendulum switch in which a pendulum is pivotally mounted at one end and weighted toward the other end for swinging motion in response to the swinging motion of the support. The free end of the pendulum defines a trajectory swinging back and forth. An electrical contact at one end of the trajectory constrains the pendulum motion and makes and breaks an electrical circuit. Other periodic switches and inertial switches may also be used such as for example a weighted button or metal disk, a switch button pushed by the user at the end of each swing or other cyclic motion, mercury switch, inductive switch, capacitive switch, as well as other periodically or inertially activated switches for measuring a cycle of the reciprocating motion back and forth or other cyclic or repetitive motion and for indicating the start of each period.

The support may also be constructed as a two dimensional array for cyclic motion. In that case the array of lights may be a two dimensional array of lights for sweeping across a volume of space during repetitive motion of the support. The microcontroller is programmed for synchronizing the turning on and off of respective lights according to the time interval or period of the cyclic motion of the support for forming a three dimensional image across the volume of space.

The image displayed by the display device may also be a cartoon character or other graphic image for animation. The microcontroller can be programmed to cause animation of the cartoon character or other image in successive swings of the support. Whether a cartoon image, message of alphanumeric characters, or other image, the microcontroller is typically programmed to set the center of the image at the center of a sweep across a region of space according to the time interval or cycle time of a cycle of the cyclic or periodic motion.

Synchronization of the display with potentially variable rate cyclic or repetitive motion is generally accomplished as follows. First the controller is constructed or programmed to initiate image displays with reference to a common reference point in each cycle or period of the cyclic motion. For example as noted above the controller is typically programmed to initiate image displays so that they are centered with reference to a central location of each cycle or period. Other reference points in a cycle or period can of course also be used. Using a reference point in the cycle, displays can be initiated at different intervals or phases from the reference point according to the length or width of the image. According to this procedure, displays are initiated at different percentages of the cycle according to the length or width of the image. In some environments, a different approach can be used, initiating the display of an image at the same fixed point or interval after the start of each cycle. This alternate approach initiating image display at the same point in each cycle may be useful in environments with fairly regular motion and cycle rate such as running shoes.

In order to set the point, time or phase in each cycle when the image display should be initiated, the controller measures the cycle time or period of the repetitive motion. The data for determining cycle time is provided by the periodically activated switch which indicates the initiation of each cycle. A prediction is made for the period of the next cycle based on the measured periods of previous cycles, assuming some consistency in the motion of the display device. For example the prediction for the present cycle can be based solely on the next preceding cycle or on an average of a select number of preceding cycles. For example, timing and synchronization for the present cycle can be based on the average cycle time period or rate of the preceding two or three cycles.

Second, the controller is constructed or programmed to determine the rate at which image displays are changed. This rate is determined by the rate of the cyclic or repetitive motion and cycle time or period measured with reference to the periodically actuated switch. The periodic switch which is generally actuated each cycle provides the data controlling the rate of change of the displays. Typically an image is constructed from successive columns of pixels as the lights of the array are selectively turned on and off while sweeping across a region of space as hereafter described. The controller controls the rate at which the column of pixels changes by controlling the turning on and off of lights according to the measured cycle time or period of the cyclic motion.

In the preferred example embodiment, the microprocessor of the display device incorporates the following timing routine to accomplish the timing and synchronizing tasks. Generally, the display device timing routine provides timing information for the current cycle of reciprocating passes back and forth or other cyclic motion based upon the period of the preceding cycle. At the same time the display device measures the time duration of the current period for use in the timing and synchronizing tasks for the next cycle of reciprocating passes back and forth or other cyclic motion. This timing routine assumes some consistency in the cycle period by a human user although in principle the next cycle period cannot be predicted with certainty from the current cycle period.

The timing routine generally divides the previous swing cycle period into a fixed number of m time intervals of equal duration with each interval corresponding to the display time of one column of an image. The phase or distance associated with one of the m time intervals can therefore be viewed as a column of pixels of the image with m/2 columns of pixels in each direction of the swing. Half of the m columns of pixels are displayed on the forward pass of the swing and the other half of the m columns of pixels are displayed on the return part of the swing. And, the cycle time and interval duration of the m time intervals are based upon the previous swing cycle.

By way of example, a cycle time period may be divided into m=256 time intervals with m/2=128 intervals in each pass of the swing back and forth. With a column of 9 LED's this provides a pixel resolution of 9 rows by 128 columns of pixels for each pass back or forth, right or left of, for example, a wand. Alphanumeric characters can be depicted by e.g. 7×9 pixels and associated 3×9 spacing, equals 10×9 pixel space per character. Up to 12 characters per pass of the swinging wand back and forth can then be displayed, although characters at the very ends of the swings may be "bunched".

The display device microcontroller or microprocessor includes a system clock circuit generating clock pulses. A counter is incremented by the clock pulses and software simulation generates a standard time unit signal L every n clock pulses. The column time intervals m are measured by counting the time units L in a counter CountL. L is the basic time unit of the display device. The counter CountL is programmed or preset each cycle of swinging motion back and forth or other cyclic motion to count in units of L marking the time interval of each m column display time interval of the previous cycle. The m time interval in units of L is referred to as TargetL. Thus TargetL is equal to the previous cycle time divided by m. CountL generates and outputs a signal to initiate each column display every time CountL reaches TargetL. The counter CountL resets after reaching TargetL and provides a signal for each column m.

For measuring the current cycle time period, the time unit signal L is also coupled to a divide by m counter Count/m. The Count/m counter drives another counter NewTargetL which represents in signal form the latest column time interval m in units of L. The output of the periodic switch or inertial switch is also coupled to New TargetL so that the current cycle can be counted in units of L, and the total L count is divided by m. Counter NewTargetL is reset to zero at the beginning of each swing or other cycle and is read at the completion of the cycle. The output of NewTargetL which represents the time interval of one column m of the pixels in units of L provides TargetL for the next cycle. The CountL counter then provides the output signal each count of TargetL to initiate display of the next column of pixels. TargetL represents the time interval for each of the m columns for that swing cycle based upon the previous swing cycle period.

The microcontroller is also programmed to keep a CountH, in a counter of the same name. The counter CountH is incremented each time CountL reaches TargetL. The above counter functions are implemented in a delay routine. The display routine calls the delay routine each time it needs to wait before changing the display pattern. The display routine will first load a register TargetH with a desired return time in units of column delay interval m. When CountH reaches TargetH the delay routine will return and the display routine can display the next column of the image.

The delay routine is repeated multiple times during each cycle for displaying images stored in memory. At the beginning of the cycle all counters are cleared and an initial TargetH for a particular image is loaded. The first TargetH is expressed as the column number across the swing or other repetitive motion at which the image is initiated. This initial TargetH varies according to the dimensions of the image and generally is set to center the image in the middle of the swing back or forth or other repetitive motion. However, the initial TargetH can be set with reference to any reference point in the cycle. The initial TargetH can also be set as a fixed number of columns from the start of the cycle for some applications.

When CountH reaches TargetH the first column of pixels is displayed. For each subsequent column the display routine will add one to TargetH, call the delay routine, and then display the new column. This delay and display sequence is repeated until all the columns of pixels of the selected image have been displayed. If display on the reverse portion of the swing is desired then TargetH is loaded with a value which will center the image on the reverse portion of the swing. Display will proceed as above but image data is presented in a reverse order. The rate at which TargetH is incremented and the column of pixels is changed is controlled by the controller according to the previous measured period of the cyclic motion and therefore the preceding rate or frequency of cyclic motion.

When the display for the current cycle is completed, and at least e.g. 75% of the previous cycle period has elapsed, the microcontroller program checks to determine whether the periodic switch or inertial switch has already been actuated. If so, the program waits until 100% of the previous cycle period has elapsed and then initiates a new cycle period using the TargetL value for the m column time interval just measured. If the periodic switch or inertial switch is manually held in the closed position the user can see the sequential actuation of the LED column without motion based upon the previous cycle measurements.

If the inertial switch has not been activated upon checking after 75% of the cycle time or period has elapsed, the main program awaits activation of the periodic switch or inertial switch to initiate a new cycle of repetitive motion. The New TargetL counter continues to be incremented according to the timing routine procedures described above to provide a measure of the current cycle period. The microcontroller program awaits inertial switch activation until 200% of the previous time period has elapsed without activation of the periodic switch or inertial switch, after which the display device is programmed to deem the delay a pause by the user. For example, the user may have put down the display device. In that event a default TargetL is entered in the comparator for CountL when swinging or other cyclic motion resumes. By way of example, it is noted that for continuity between swings or other repetitive motions a subsequent cycle time period must fall within the range of 75% to 200% of the previous cycle time period. Other timing patterns can of course be selected.

The invention can be implemented in a variety of environments with cyclic, repetitive or periodic motion. For example, the display device may be constructed for swinging in a circular motion or pattern by the user rather than reciprocating motion back and forth. Such a circular motion display device may also be a wand or a baton designed by cyclic circular motion or be mounted at the end of a line for swinging in a circular pattern. Other environments include bicycle pedals and spokes, running and walking shoes, and generally any situation with variable cyclic repetitive or periodic motion. A periodic timing switch is selected appropriate to each environment as hereafter described for indicating the occurrence of each cycle of the cyclic or repetitive motion and for providing a reference point at the same time and phase position for each cycle.

Multiple images can also be displayed during a cycle of the repetitive motion. For example one image can be displayed at one location of the area swept by the display device. A different image can be displayed at another location of the swept area. Display of different images is controlled by a different initial TargetH associated with the respective images.

Other objects, features and advantages of the invention are apparent in the following specification and accompanying drawings.

DESCRIPTION OF PREFERRED EXAMPLE EMBODIMENTS & BEST MODE OF THE INVENTION

A hand held wand embodiment of the present invention is illustrated in FIGS. 1–4. As shown in the simplified diagram of FIG. 1, the wand 10 is constructed with a handle 12 held by the user for swinging motion back and forth in the direction of arrows 14. A column of LED's 15 scans across a two dimensional area of space defined by the swing for display of a message or other image across the two dimensional area as hereafter described.

Figure 1:
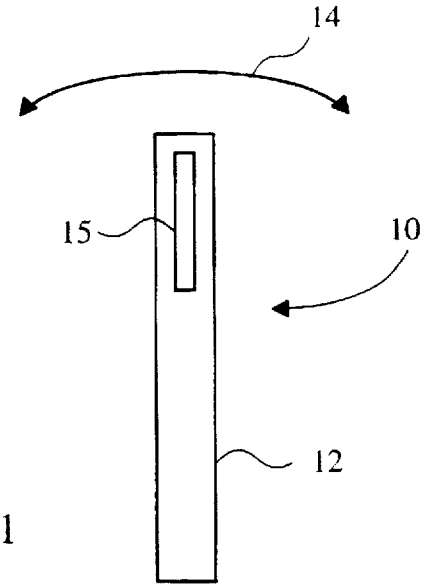
FIG. 1 is a simplified diagrammatic plan view of a hand held wand display device according to the invention.
Figure 2:
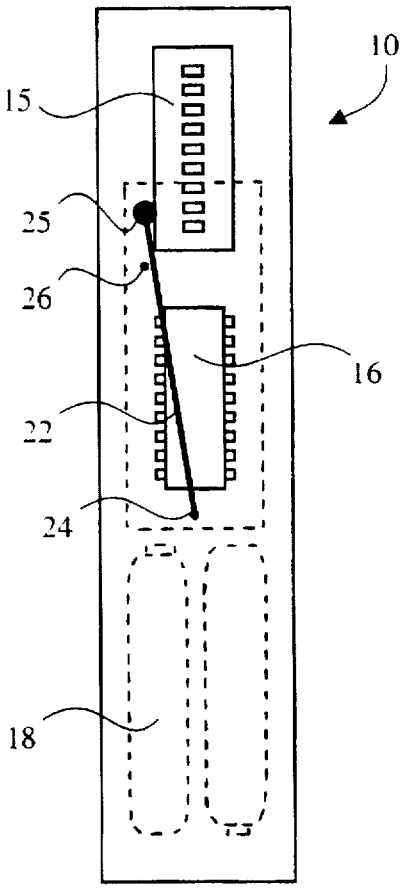
FIG. 2 is a plan view of a hardware implementation of the hand held wand display device according to the invention.
Figure 3:
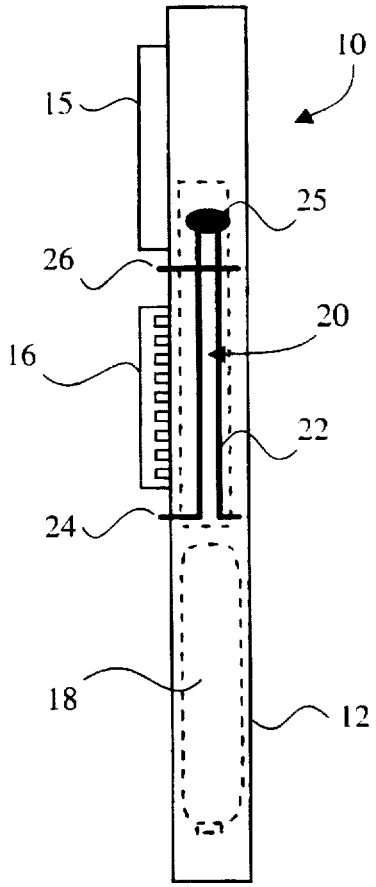
FIG. 3 is a side elevation view of the wand display device of FIG. 2.
Figure 4:
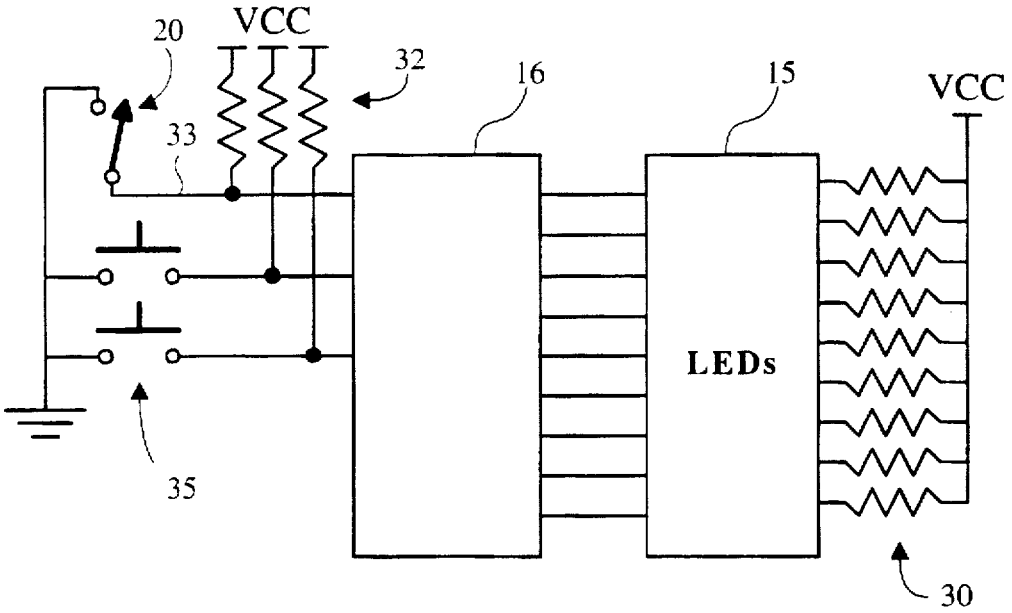
FIG. 4 is a schematic circuit diagram of the hand held wand play device.

An actual hardware implementation of the wand 10 is shown in FIGS. 2–4. The column of LED's 15 is controlled by a microcontroller 16 or other microprocessor for synchronizing the turning on and off of LED's in the column 15 to form the desired image or message as the column of LED's 15 is swept across a two dimensional area of space. The power supply is provided by batteries 18 which can be fitted in the handle portion 12 of wand 10.

An important element of the wand 10 for synchronizing the flashing of the LED's is an inertial switch 20. In this example, the inertial switch or swing switch is provided by a mechanical pendulum 22 pivotally mounted at one end 24, and weighted at the other end by a small weight 25 for pendulum motion as the wand changes direction. Swinging motion of the pendulum 22 is constrained by a bar 26 which also completes an electrical circuit when contacted by the pendulum 20 as the wand changes direction swinging back and forth. This electrical circuit provides an output signal for measuring the current swing cycle period for use in the timing routine and synchronization for the next swing cycle.

A schematic circuit diagram for the wand display device 10 is illustrated in FIG. 4. A suitable microcontroller 16 for use in the circuit is, for example, the Microchip Technologies (TM) PIC16C54 or PIC16C58. Other microcontrollers and microprocessors can of course also be used. The LED's 15 are coupled to the microcontroller 16 and through pullup resistors 30 to the power supply VCC. Inputs to the microcontroller 16 are provided by pullup resistors 32 coupled between power supply VCC and respective inputs. One input 33 is controlled by inertial switch 20. Alternative inputs are controlled by mode buttons 35 for selecting a particular mode of operation of the wand display device or for editing the message or other image as hereafter described.

Figure 5:
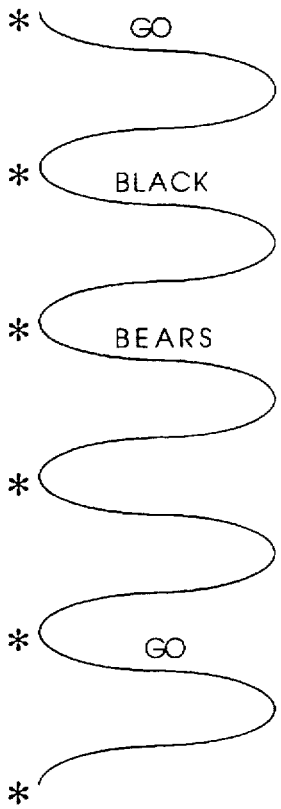
FIG. 5, 6, & 7 are action diagrams illustrating three modes of operation of the hand held wand display device.
Figure 6:
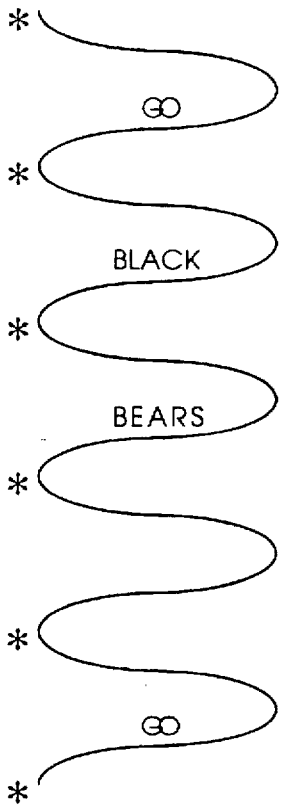
Figure 7:
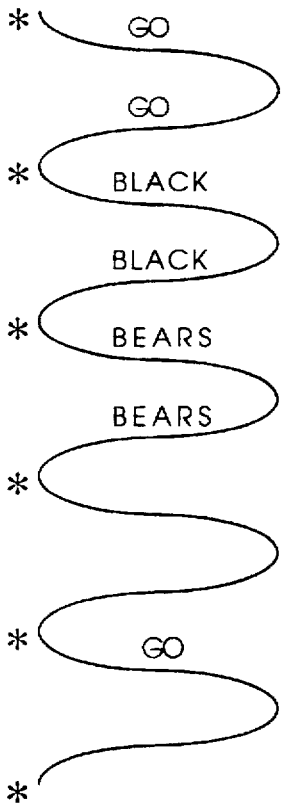

Three example modes of operation of the hand held wand display device are illustrated in FIGS. 5, 6, & 7. The curved line in each Figure represents the swinging motion of the wand back and forth sweeping across the area in which an image is displayed. The swinging motion back and forth would typically be at the same location but is shown schematically here as a descending sine wave in order to indicate the different images. The asterisks in each of these figures represent the point or side of the swinging motion at which the inertial switch is activated. In this example the image is a message set forth by alphanumeric characters. One full cycle of swinging motion is represented by a full pass to the right followed by a full pass to the left or vice versa.

FIG. 5 represents a mode of operation of the wand display device in which an image is displayed on each right pass of the wand during each cycle. During the left hand pass of the swing no image is displayed. In the example of FIG. 5 the successive images on each right pass of the swing of successive cycles is an image of alphanumeric characters conveying a message to a viewer looking at the region of space, in this case a two dimensional area, scanned by the LED column on the wand. The successive words of the message GO BLACK BEARS are seen on each right hand pass of successive swing cycles. This has been found to be a preferred mode of operation for delivering a message readable by a viewer with sufficient time between words provided by the left hand pass of the swing for a viewer to see, adsorb and read the message. FIG. 6 illustrates a similar mode of operation in which the images are displayed on the left hand pass of successive swing cycles while no image is displayed on the right hand pass. In the example of FIG. 6, image data is presented in reverse order.

In the mode of operation of FIG. 7 an image is displayed on both the right hand pass and left hand pass of each successive cycle. In this example the images are also alphanumeric characters formed into words that convey the same message. In each case the word image is repeated on both the right hand pass and left hand pass of a cycle. It should be kept in mind that FIGS. 5–7 are diagrammatic representations of a display which generally remains in the same place as the wand is swept back and forth by the user. In the example of FIG. 7 each word persists in the image field of pixels swept by the wand for a longer duration than the modes of operation in FIGS. 5 and 6. Specifically the image of each word endures for an entire cycle of both a right pass and left pass of one swing cycle. This facilitates reading and adsorbing the message by a viewer.

It has been found that changing the word on every left and right hand pass of the swing of the wand presents a changing display that is difficult to read because of the speed at which the words change. However, this mode is suitable for animation of cartoons or other graphic images. It is preferable to use the modes illustrated in FIGS. 5 and 6 for messages in which a word is displayed on either every left hand pass or every right hand pass. The mode of operation in FIG. 7 is suitable for uses in which the same word or other image is repeated during the right and left hand passes of each cycle or for animation of images.

Figure 8:
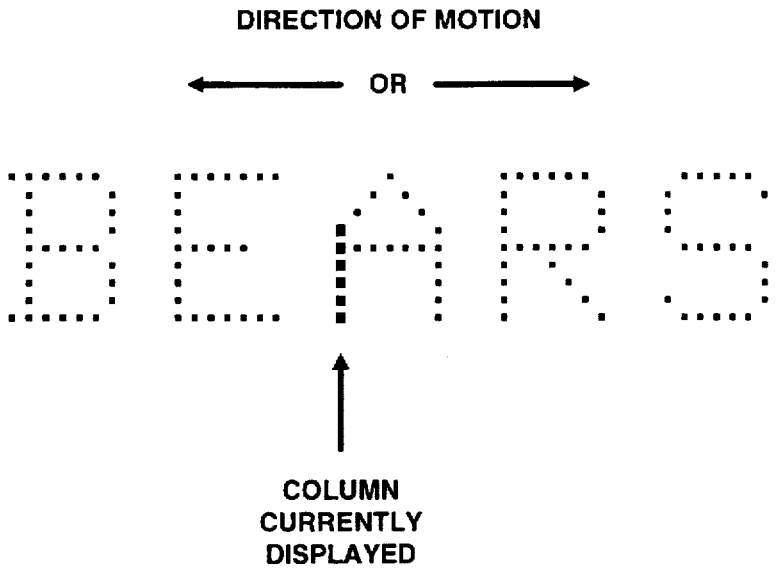
FIG. 8 is a detailed diagram of the columns of pixels composing the word BEARS during swinging motion of the hand held wand display device.

Referring to FIG. 8, as the wand display device is swept across the display area, the column of LEDs is controlled by the microcontroller for flashing on and off the LED's to produce the image of alphanumeric characters. The particular arrangement or sequence of on and off LED's changes every m time interval to produce the effective pixels across the scanned area in cooperation with the persistence of vision of human viewers. In the example of FIG. 8 the wand is shown at a location near the center of the scan path with six LED's lighted forming the left leg of the letter A and three LED's are off. The pattern changes every m time interval corresponding to every pixel column until the image has been presented. The wand display device does not initiate the successive patterns of columns until after the initial TargetH delay from the beginning of the swing selected for each word or other image. In this example, the initial delay TargetH as hereafter described approximately centers the word BEARS in the center of the swing or scan path of the wand display device. Reference points other than the center can also be used.

Figure 9:
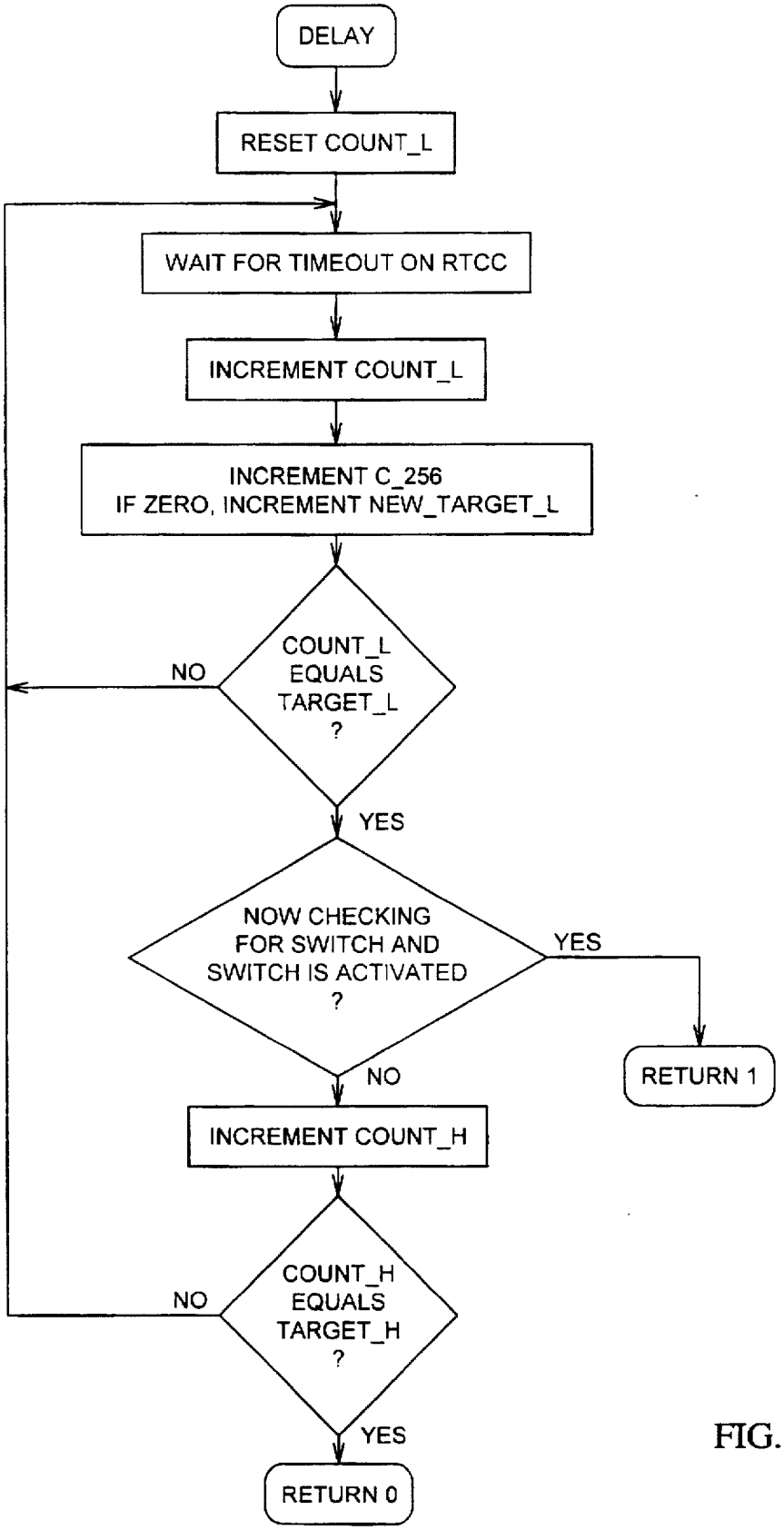
FIG. 9 is a flow chart of the timing and delay routines implemented by the microcontroller.
Figure 10:
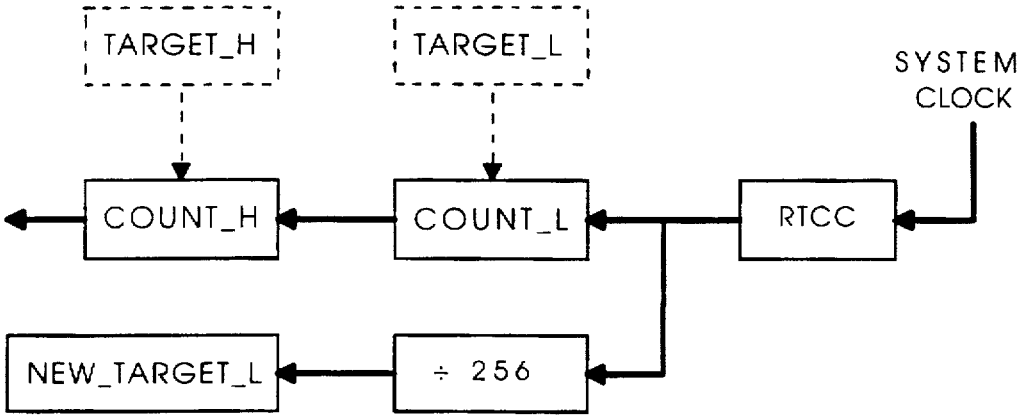
FIG. 10 is a block diagram showing the relationships of the counters and targets for timing and delay routines.

The timing routine program of microcontroller 16 for the wand display device 10 is set forth in the flow chart of FIG. 9 which is also understood with reference to the block diagram showing the relationship of the counters set forth in FIG. 10. At the beginning of a swing cycle all the counters are reset to zero. As shown in FIG. 10 a system clock provides high frequency timing signals at for example 500 KHZ to counter RTCC. The system clock therefore increments counter RTCC every 2 microseconds. Counter RTCC counts the clock pulses and generates an output every n clock pulses for incrementing counter CountL. The counter CountL provides the time units L for timing routines associated with the wand display device. CountL is incremented in units of time L, counting the units of time L upon initiation of a swing. By way of example, counter RTCC may be set to count $2^6$ or 64 clock pulses for each time unit L.

Associated with the counter CountL is a comparator target value TargetL equal to the previous period divided by for example 256. TargetL is thus the duration of one of the m column intervals representing a column of pixels of the display where m=256 in this example. Each cycle is divided into 256 pixel columns, 128 for the right pass of the swing and 128 for the left pass of the swing. When CountL reaches TargetL the counter CountH is incremented, counting the number of column intervals that have passed since initiation of the swing. Also as shown in the flow chart of FIG. 9 when CountL equals TargetL, if the display routine is in the synchronization portion, the routine checks to determine whether or not the inertial switch has been activated.

Associated with the counter CountH is a comparator value TargetH representing the number of the column intervals m to delay or wait before returning from the delay routine. TargetH is initially set for each different image according to the length of the image or message for generally centering the image in the scan path. The delay routine is also called before displaying each new column of the image. TargetH is therefore incremented by the display routine before each call. When CountH equals TargetH the delay routine returns execution to the display routine hereafter described which displays the next column of the image. The rate at which the column displays are changed is controlled by the microcontroller according to the measured cycle time period of the next preceding cycle and therefore the rate of the preceding cyclic or repetitive motion indicated by the periodically actuated timing switch.

The block diagram of FIG. 10 also shows a parallel path from the counter RTCC which is also reflected in the flow chart of FIG. 9. The output of Counter RTCC also goes to a divide by 256 counter. The time interval in units of time L representing one swing cycle period determined by checking the inertial switch is divided into 256 time intervals and the result equal to one of the m time intervals is stored in the register NewTargetL. NewTargetL becomes the TargetL for the next swing cycle period, the comparator for comparison with the count at counter CountL.

In the absence of a new TargetL, TargetL defaults to a value of 16, that is 16 time units L. The default swing period that is used whenever swinging is initiated without a previous swing by way of example is equal to 0.5 seconds. If RTCC is used as a six bit counter then the default period is equal to the system clock period of 2 μS times the RTCC count of 64 clock pulses equalling the basic time unit L, times 16 L time units of the default TargetL representing the m column interval, times the 256 column intervals per period. As a result the default swing period interval is 0.5 seconds by way of example.

Figure 11:
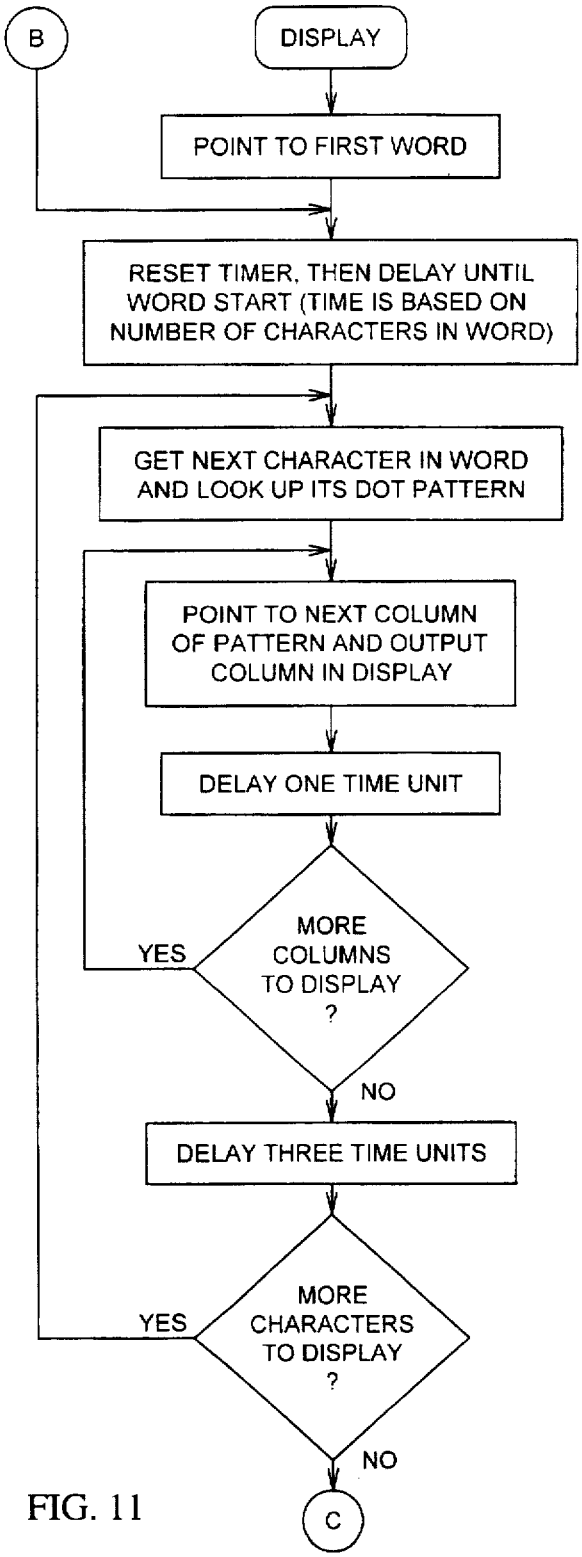
FIG. 11 is a flow chart of the image display portion of the display routine in which the image for one pass is displayed.
Figure 12:
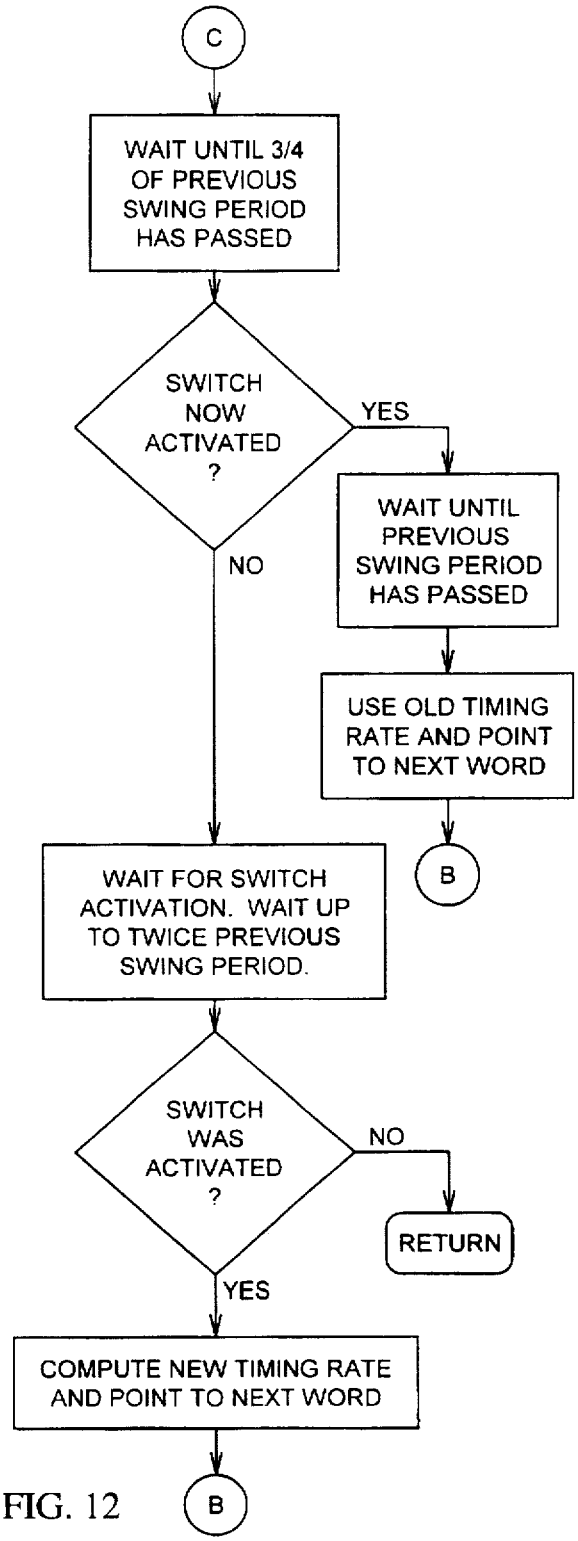
FIG. 12 is a flow chart of the synchronization portion of the display routine in which the software waits for next switch actvation.

Referring to the example of FIG. 8, the timing routine and display routine of the flow chart of FIG. 11 establish the following sequence of events. Each alphanumeric character of the word BEARS is represented by 7×9 pixels, that is 7 of the m columns by 9 rows provided by the LED's. In addition to the seven columns three column spaces are also associated with each alphanumeric character. The total columns required for the word BEARS out of the 128 columns available in the right pass of the swing is therefore 50 columns. If the periodic switch, in this case inertial switch 20, activates at the exact end of a swing, the center of the scan path is selected to be column 64 and the word BEARS is centered on column 64. If the periodic switch activates at another location in the cycle for example relative to a different reference point, the column number for the image center is appropriately shifted in phase and selected for approximately centering the image. The initial TargetH comparator value is set with the appropriate column number for approximately centering the word BEARS in the scan path.

In this example ½ of the 50 display columns appear to the left of the center column 64 and ½ of the display columns would appear on the right of the center column 64. The initial delay TargetH is therefore 64–25 or column No. 39 when the counter CountH reaches TargetH. At column 39 the display routine initiates changing the flashing or on off pattern of the column of LED's every m time interval. The delay routine is again used for timing, but TargetH is incremented before each call. The letter B and its accompanying space occupy columns 39–48, the letter E and its associated space occupy columns 49–58 the letter A and its associated space occupy columns 59–68, the letter and its associated space occupy columns 69–78, and finally the letter S and its associated space occupy columns 79–88.

By way of another example the letter GO occupies only two alphanumeric character intervals centered on the center column 64 of the right pass of a swing cycle. The ten columns representing the letter G are on the left of the center column 64 while the ten columns representing the letter O are on the right of the center column 64. The initial TargetH for the word GO is therefore 54. When countH equals the initial TargetH of 54, the display routine initiates displaying a distinct pattern of flashing or on/off pattern of the LED's every m time interval.

Messages and images to be displayed by the wand display device are generally stored in a ROM of the microcontroller, an EEPROM, or RAM in which the message or image can be programmed and edited. The display routine points to the first word for example of an alphanumeric message then delays until the start of display of the word. The character and its dot pattern are presented pointing column by column to the pattern to be displayed each m time interval. When the columns of a character are completed there is a delay of three time intervals m representing three pixel columns of the scanned area for spacing before display of the next character.

A swing cycle is concluded by the synchronization portion of the display routine shown in the flow chart of FIG.

12. After 75% of a particular swing period has been completed the microcontroller checks to see if the inertial switch is already activated and if so the previous swing cycle time period is used for the timing and display routines for the next swing cycle. Otherwise, the synchronization portion of the display routine waits for inertial switch activation. If there is no activation of the inertial switch after two swing periods of the previous swing cycle period have passed then the wand display device microcontroller is programmed to assume that the user has put down the device. In this case, for any new activation of the inertial switch a new swing cycle time period is computed based upon default values for the timing and display routines of the next swing period.

Figure 13:
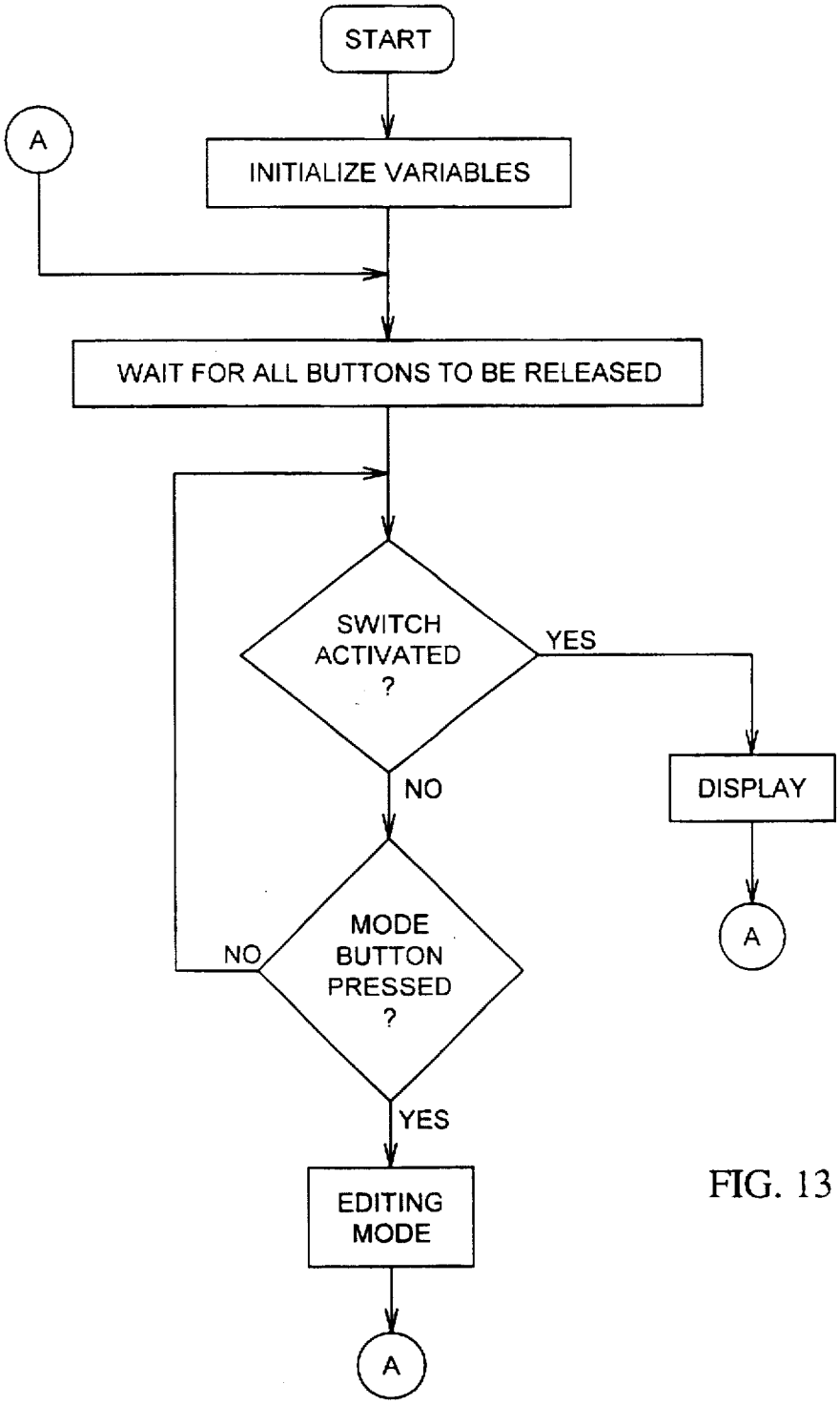
FIG. 13 is a flow chart of the main program which is execute during a pause of the swinging motion.

FIG. 13 shows a flow chart of the main program which initializes variables and checks whether the inertial switch has been activated or the mode buttons have been pushed. The microprocessor or microcontroller executes this portion of the code during a pause of the swinging motion. The mode buttons can be used for example to change modes as given in FIGS. 5–7 or for editing the message or image to be displayed. The message can be entered using for example Morse code, or the buttons can be connected to a remote device such as a personal computer for downloading of the display data.

Figure 14:
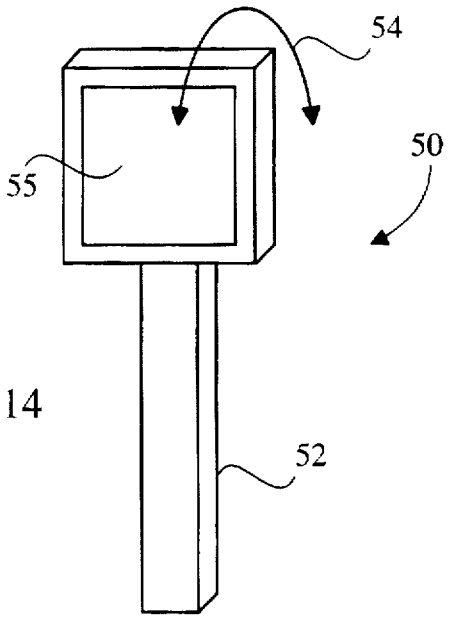
FIG. 14 is a simplified diagrammatic view of a hand held wand display device for displaying 3-D characters and images.

A variety of alternative embodiments of the invention are illustrated in FIGS. 14–17. FIG. 14 illustrates a wand 50 for displaying 3 dimensional images in a volume region of space. The wand 50 is similarly provided with a wand handle 52 for manual operation by swinging back and forth in the direction of the arrows 54. In this example however the LED's 55 are in a 2 dimensional array covering a plane. As the plane is swept back and forth the LED's scan a 3 dimensional volume of space. Control of flashing or on/off patterns of the LEDs are controlled in the manner heretofore described with reference the wand display device 10 which presents two dimensional images. In the example of FIG. 14 however the LEDs scan a three dimensional volume of space and the persistence of vision of a human viewer will therefore enable perception of a three dimensional image.

Figure 15:
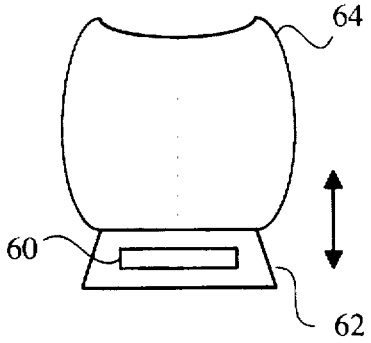
FIG. 15, 16, & 17 are simplified diagrammatic views showing further embodiments of the invention in environments of reciprocating motion namely the back of a shoe and back of a bicycle pedal, and an environment of intermittent motion on the side of a shoe.
Figure 16:
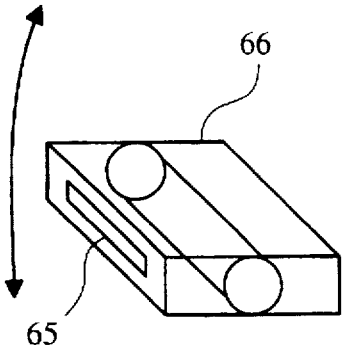
Figure 17:
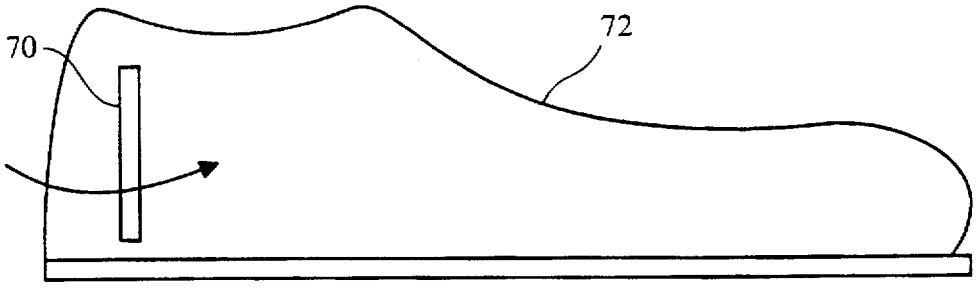

The examples of FIGS. 15, 16 and 17 return to one dimensional LED arrays that produce two dimensional images.

In the example of FIG. 15 the column of LEDs is turned 180° to form a row 60 of LEDs embedded in the back of the heel 62 of a running shoe 64. The reciprocating up and down motion of the runners feet scans the row of LEDs 60 over a two dimensional space for displaying messages or other images. In this case the periodic switch can be a pressure switch activated at the same time each cycle as the runners foot hits the ground. An inertial switch can also be used.

Similarly a row of LEDs 65 can be embedded in the back of a bicycle pedal 66. The reciprocal motion up and down of the bicycle pedal can be used to scan the row of LEDs 65 over a two dimensional area for displaying an image or message. In this case the periodic switch can be a mechanical electrical, magnetic or optical switch on the bicycle activated by each pass of the pedal crank at the same location each period of the cyclic rotation.

A further example is shown in FIG. 17 in an environment that produces periodic repetitive intermittent motion in the same direction rather than reciprocating motion back and forth in opposite directions. In the example in FIG. 17 a column of LEDs 70 are embedded in a vertical configuration along the side of a shoe 72. As the walker brings shoe 72 forward during walking motion the column 70 of LEDs scans a two dimensional area of space and can be used therefore to display a message or image. Rather than return in the opposite direction the column of LEDs 70 stops but then keeps going in the same direction before stopping again. The motion is repetitive or cyclic intermittent periodic motion alternately stopping and moving in the same direction.

Operation of the intermittent motion display device is similar to the wand 10. The same inertial switch measures the period of the intermittent motion stopping and starting. Alternatively, the periodic switch can be a pressure switch in the shoe actuated each step at approximately the same time in the repetitive step cycles. The timing routines and display routines remain the same.

By way of another example, bicycle spokes can be used for presenting image displays. The LED's can be located along one or more spokes and actuated for example during either a horizontal or vertical portion of the cyclic motion. The periodic switch can be a mechanical, electrical, magnetic, or optical switch actuated each time a selected spoke passes the same location during the cyclic movement of the wheel spokes.

Figure 18:
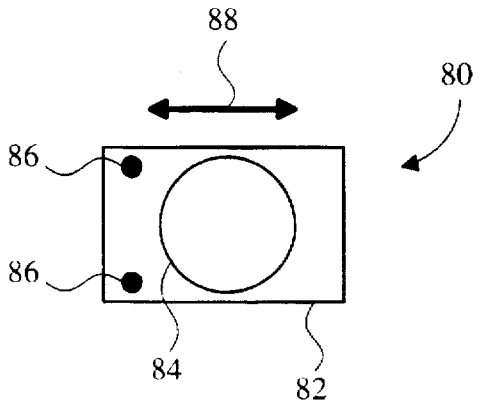
FIG. 18 is a diagrammatic view of another periodically actuated inertial switch according to the invention.

FIG. 18 shows another example of an inertial switch. The inertial switch 80 is composed of two contacts 86 and a spherical or disk-shaped conductor of metal or other conductive material 82 sliding back and forth in direction 88 in a slot 82. The conductor 84 creates a connection between contacts 86 at one end of its motion 88. The conductor 84 has sufficient mass and freedom of movement so that it moves freely in response to motion of the display device.

An important feature of the periodically actuated timing switch generally is that it actuate each cycle of the repetitive or cyclic motion and that it actuate at approximately the same phase of the cycle or the same time in the period of the cycle. This is accomplished essentially automatically by an inertial switch. It can also be accomplished mechanically, electrically, magnetically or optically by a switch appropriately placed in the particular environment of the repetitive motion. For example a pressure switch can be used for the shoe displays as noted above. For a display device that is swung in a circle by the user, the pressure switch can be located in the handle, actuated by the thumb or hand at the same point in each cycle. In each example, the periodically actuated timing switch is selected to provide a measure of the cycle time period and therefore the rate or frequency of the cyclic, repetitive or periodic motion.

Figure 19:
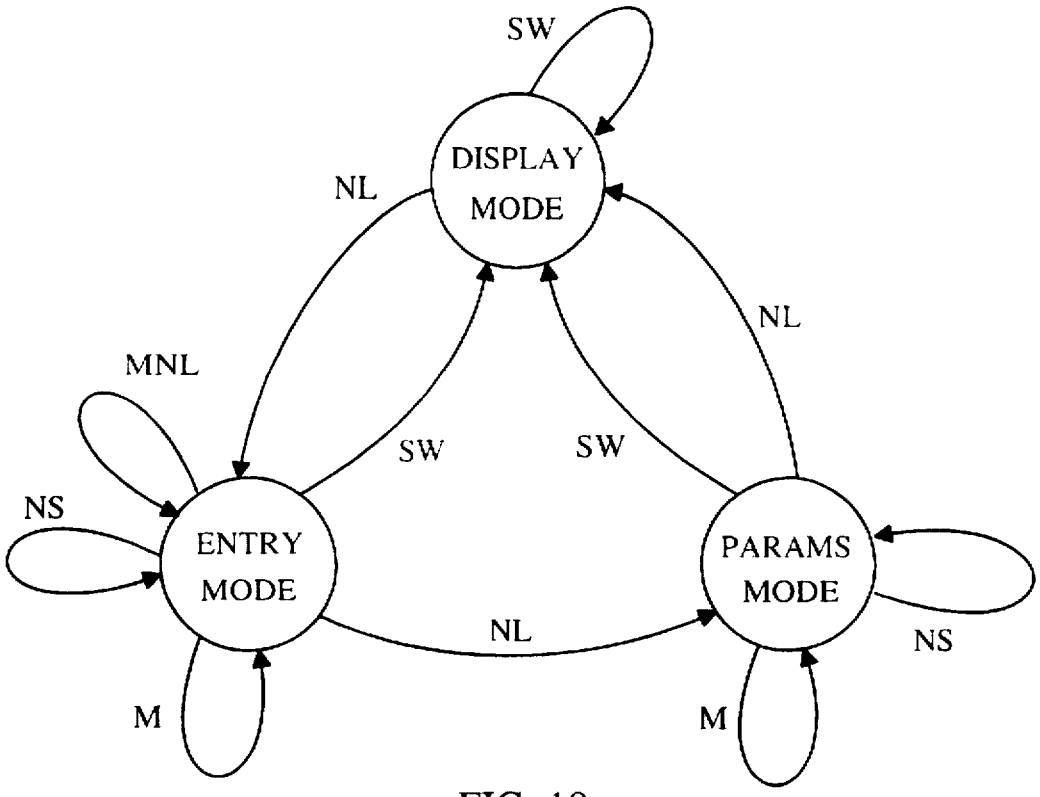
FIG. 19 is a mode diagram showing different modes of operation of the display device and how to actuate each mode.

FIG. 19 shows an example of a state diagram for an editing mode using Morse code for entry of a message. This example assumes the device has two buttons, M and N, in addition to the timing switch, SW. In this diagram NS represents a short push of button N, NL represents a long push of button N, M represents a push of button M, MNL represents a long push of both buttons, and SW represents activation of the timing switch. The LED display can be used to give the user feedback about the button pushes. For example a short push places a nonblinking pattern in the LED display, while a long push (longer than e.g., 2 seconds) makes the pattern blink. Holding the button longer than, for example, 5 seconds is used as a cancel feature (i.e., the button push is ignored).

In this example three modes are used: a Display Mode in which the device displays the current message, an Entry Mode for entering and editing of a message, and a Parameter Changing Mode in which the user selects for example the type of display (FIGS. 5–7), the column number of the image center, and perhaps a default TargetL value. In this example the buttons operate as follows. Timing switch activation in any mode immediately puts the device in the Display Mode and message display will begin. A long push on button N will advance control to the next mode. In Entry Mode a long push of both buttons will clear the message, a short push of button N will advance to the next word and button M will be used to enter characters in Morse code. Entering 8 Morse code dots clears the current word. Note that using a short push of button N to advance to the next word rather than a pause between characters will allow an inexperienced user time to look up codes from a table. In Parameter Changing Mode a short push of button N will advance to the next parameter, while button M can be used to advance the chosen parameter through all of its options. The LED display can be used for user feedback.

According to another display mode of the repetitive motion display device, more than one image can be displayed at different points or locations of the area swept by the LED array or other array of lights. For example, if the display device sweeps a circular area, one image can be displayed at 3:00 o'clock and another different image can be displayed at 9:00 o'clock in the circular area swept by the array of lights. Or, different images can be displayed for example at 12:00 o'clock, 3:00 o'clock, 6:00 o'clock and 9:00 o'clock. One image may be a pictorial representation and another image may be a word or words. Synchronization and coordination of multiple images is organized and arranged in the same manner as a single image described above with a different initial TargetH for each of the separate images.

A remote device can be connected to the button inputs for entry of a message. For example the inputs can be coupled to the serial communication port of a personal computer for communication using RS-232.

While the invention has been described with reference to particular example embodiments it is intended to cover all modification and equivalents within the scope of the following claims.

I claim:

1. A display device comprising:

a support constructed for cyclic motion;

an array of lights mounted on the support for sweeping across a region of space during the cyclic motion of the support;

a controller coupled to the lights for turning on and off the respective lights of the array;

a periodically actuated switch coupled to the controller for measuring the time interval or cycle time period of a cycle of the cyclic motion of the support and for indicating initiation of a cycle;

a clock circuit generating clock pulses;

a counter circuit coupled to the clock circuit for counting clock pulses and generating a time unit signal L every n clock pulses, said controller being programmed to count time unit signals L in a counter CountL;

said controller being programmed to determine the cycle time period of a cycle of motion of the support divide the cycle time period into a fixed number of m time intervals each having a duration TargetL where TargetL is a specified count of the counter CountL equal to the cycle time period divided by m, said controller being programmed to count the time intervals m in a counter CountH, CountH being incremented each time CountL reached Target L;

said controller being programmed to introduce a delay by a delay routine synchronized with the cycle time period before turning on and off the lights of the array during a cycle of the cyclic motion of the support said delay being values of TargetH set for each particular image, said controller turning on and off lights of the array when CountH equals TargetH;

said controller being programmed for synchronizing the turning on and off of respective lights of the array according to the time interval or cycle time period of a cycle of the cyclic motion of the support for forming an image across the region of space swept by the array of lights using persistence of vision of a viewer.

2. The display device of claim 1 wherein the controller is constructed for controlling initiation of display of at least one image at a selected point in a cycle of the cyclic motion.

3. The display device of claim 2 wherein the periodically actuated switch provides a reference point at substantially the same phase position in each cycle and wherein the controller is constructed for initiating display of at least one image at a selected point during a cycle with reference to said reference point.

4. The display device of claim 3 wherein the selected point during a cycle of cyclic motion for initiating display of an image is a fixed time interval from the reference point provided by the periodically actuated switch.

5. The display device of claim 3 wherein the selected point during a cycle of the cyclic motion for initiating display of an image is varied according to the dimensions of the image and the period of the cycle for initiating display of the image at different percentages of a cycle with reference to said reference point.

6. The display device of claim 1 wherein the controller is constructed for controlling the rate at which an image is displayed according to at least one measured time interval or cycle time period of a cycle of the cyclic motion of the support.

7. The display device of claim 6 wherein the image is formed by successive columns of pixels as the array of lights sweeps across the region of space, and wherein the controller is constructed for controlling the rate of change of the columns of pixels by controlling the rate of turning on and off of respective lights of the array of lights according to at least one measured time interval or cycle time period of a cycle of the cyclic motion.

8. The display device of claim 6 wherein the controller controls the rate at which an image is displayed based upon the preceding measured time interval or cycle time period of the preceding cycle.

9. The display device of claim 6 wherein the controller controls the rate at which an image is displayed based upon at least two preceding measured time intervals or cycle time periods of the preceding cycles.

10. The display device of claim 1 wherein the display device is constructed for reciprocating motion with two directions of sweep per cycle and wherein the controller is programmed for synchronizing the turning on and off of respective lights to form images during one direction of sweep of the array of lights during a cycle of the cyclic motion and to turn off the lights for the other direction of sweep.

11. The display device of claim 1 wherein the display device is constructed for reciprocating motion with two directions of sweep per cycle and wherein the controller is programmed for synchronizing the turning on and off of respective lights to form images for both directions of sweep of the array of lights during a cycle of the swinging motion.

12. The display device of claim 1 wherein the controller is programmed for synchronizing the turning on and off of respective lights according to the measured cycle time period of the cyclic motion of the support to form alphanumeric characters.

13. The display device of claim 12 wherein the alphanumeric characters form words during cyclic motion of the support and successive words displayed during cyclic motion of the support form a message.

14. The display device of claim 1 wherein the support is a hand held wand for hand held swinging motion back and forth and wherein the array of lights comprises a column of lights mounted along the wand for sweeping across a two dimensional area of space during hand held swinging motion of the wand back and forth.

15. The display device of claim 14 wherein the lights of the array are LED's.

16. The display device of claim 14 wherein the controller is programmed for synchronizing the turning on and off of respective lights to form an image for one direction of motion of the swing of the wand during a cycle of swinging motion of the wand back and forth and to turn off the lights for the other direction of motion of the swing of that cycle.

17. The display device of claim 14 wherein the controller is programmed for synchronizing the turning on and off of respective lights to form an image during both directions of motion of the swing of the wand during a cycle of the swinging motion.

18. The display device of claim 1 wherein the periodically actuated switch is an inertial switch mounted on the support and wherein the inertial switch is a pendulum switch comprising a pendulum pivotally mounted at one end and weighted toward the other end for swinging motion in response to the swinging motion of the support, the free end of said pendulum defining a trajectory back and forth, and further comprising an electrical contact at one end of the trajectory for making and breaking an electrical circuit.

19. The display device of claim 1 wherein the periodically actuated switch is an inertial switch, and wherein the inertial switch comprises an electrically conductive object mounted for sliding movement in a trajectory back and forth within a cavity, one side of said cavity being formed with a pair of spaced apart electrical contacts, said object forming a conductive bridge between the electrical contacts at one end of the trajectory back and forth.

20. The display device of claim 1 wherein the controller is programmed to set the center of the image at the center of the sweep across a region of space according to the measured time interval or cycle time period of a cycle of the cyclic motion.

21. The display device of claim 1 wherein the support is mounted on shoes.

22. The display device of claim 1 wherein the controller is constructed for controlling the rate at which an image is displayed at a fixed rate.

23. The display device of claim 1 wherein the controller is programmed to form a plurality of different images across the region of space swept by the array of lights.

24. A display device comprising:

a support constructed for cyclic motion;

an array of lights mounted on the support for sweeping across a region of space during the cyclic motion of the support;

a controller coupled to the lights for turning on and off the respective lights of the array;

a periodically actuated switch coupled to the controller for measuring the time interval or cycle time period of a cycle of the cyclic motion of the support and for indicating initiation of a cycle;

said controller being programmed for synchronizing the turning on and off of respective lights of the array according to the time interval or cycle time period of a cycle of the cyclic motion of the support for forming an image across the region of space swept by the array of lights using persistence of vision of a viewer;

wherein the image is at least one graphic image; and wherein the controller is programmed to cause animation of the graphic image in successive sweeps of the support.

25. A display device comprising:

a support constructed for cyclic motion;

an array of lights mounted on the support for sweeping across a region of space during the cyclic motion of the support;

a controller coupled to the lights for turning on and off the respective lights of the array;

a periodically actuated switch coupled to the controller for measuring the time interval or cycle time period of a cycle of the cyclic motion of the support and for indicating initiation of a cycle;

said controller being programmed for synchronizing the turning on and off of respective lights of the array according to the time interval or cycle time period of a cycle of the cyclic motion of the support for forming an image across the region of space swept by the array of lights using persistence of vision of a viewer;

wherein the image is at least one alphanumeric image; and wherein the controller is programmed to cause a message to be displayed, said message comprising a different alphanumeric image in successive sweeps of the support.

* * * * *